US006218778B1

(12) United States Patent
Tomita et al.

(10) Patent No.: US 6,218,778 B1
(45) Date of Patent: Apr. 17, 2001

(54) FIELD EMISSION DEVICE HAVING INTERLAYER CONNECTIONS

(75) Inventors: Masaharu Tomita; Shigeo Itoh; Kazuhiko Tsuburaya; Kazuyuki Yano, all of Mobara (JP)

(73) Assignee: Futaba Denshi Kogyo Kabushiki Kaisha, Mobara (JP)

( * ) Notice: Subject to any disclaimer, the term of this patent is extended or adjusted under 35 U.S.C. 154(b) by 0 days.

(21) Appl. No.: 09/164,373

(22) Filed: Oct. 1, 1998

(30) Foreign Application Priority Data

Oct. 2, 1997 (JP) ..... 9-269741

(51) Int. Cl.[7] ..... H01J 1/62

(52) U.S. Cl. ..... 313/495; 313/309; 313/336; 313/51

(58) Field of Search ..... 313/495, 496, 313/497, 309, 310, 336, 51; 315/169.1

(56) References Cited

U.S. PATENT DOCUMENTS 5,075,595 * 12/1991 Kane ..... 315/169.1
5,528,103 * 6/1996 Spindt et al. ..... 313/497
5,760,810 * 6/1998 Onodaka ..... 347/123
5,903,098 * 5/1999 Jones ..... 313/495

* cited by examiner

*Primary Examiner*—Nimeshkumar D. Patel
*Assistant Examiner*—Karabi Guharay
(74) *Attorney, Agent, or Firm*—Oblon, Spivak, McClelland, Maier & Nuestadt, P.C.

(57) ABSTRACT

A field emission device capable of permitting a focusing electrode to be arranged around a gate electrode without any restriction. A gate electrode is arranged on an upper surface of an insulating layer of a cathode substrate-side structure and holes are formed through the insulating layer and gate electrode. A conical emitter is arranged in each of the holes. The insulating layer is formed on the upper surface thereof with a focusing electrode so as to surround the gate electrode. The insulating layer is formed on a lower surface thereof with a connection line, a resistive layer and a cathode electrode line. The gate electrode is electrically connected to the connection line through a contact hole and a gate electrode line is electrically connected to the connection line through another contact hole.

2 Claims, 4 Drawing Sheets

FIELD EMISSION DEVICE HAVING INTERLAYER CONNECTIONS

BACKGROUND OF THE INVENTION

1. Field of the Invention

This invention relates to a field emission device, and more particularly to a field emission device suitable for use for a field emission display (FED) or the like.

2. Discussion of the Background

An FED generally includes an envelope which is formed by sealedly joining a cathode substrate-side structure and an anode substrate-side structure to each other while being spaced from each other at a predetermined interval and is then evacuated to a high vacuum. The FED includes a field emission cathode (FEC), which may be constructed into a Spindt-type cold cathode structure. In the FEC of this type, application of a draw-out voltage to a gate electrode permits a conical emitter arranged in each of holes formed through the gate electrode to field-emit electrons, resulting in a phosphor of an anode electrode which has a positive voltage applied thereto emitting light, leading to display operation.

An FED of the high-voltage type exhibits increased luminance as compared with that of the low-voltage type, because in the former, a phosphor for a high voltage is increased in luminance. The FED of the high-voltage type is adapted to apply a voltage of several kV between an anode and a gate, so that it is needed to increase a gap between the anode and the gate. Thus, in the FED of the high-voltage type, it is required to focus electron beams emitted. In general, the FED has an FEC of the two-stage gate type incorporated therein. The FEC of the two-stage gate type is constructed so that a layer of a focusing electrode is provided separately from that of a gate electrode to provide a two-stage layer structure. This increases the number of layers, to thereby render manufacturing of the FEC costly and troublesome. In view of the problem, an FEC of the plane focusing type wherein a focusing electrode and a gate electrode are arranged in the same plane is proposed to simplify a process of manufacturing.

Such a plane focusing type FEC is generally constructed in such a manner as shown in FIGS. 5 and 6, wherein reference numeral 31 designates a focusing electrode, 32 is a gate electrode, 32*a* is holes, 11 is a conical emitter arranged in each of the holes 32*a*, 12 is an insulating layer, 13 is a cathode substrate, 33 is a resistive layer, and 34 is a cathode electrode line.

The plane focusing type FEC fails to fully surround the gate electrode 32 with the focusing electrode 31. Thus, the focusing electrode 31 and gate electrode 32, as shown in FIG. 5, each are formed into a pectinate configuration and arranged on the same plane on the insulating layer 12 while alternating with each other. The gate electrode 32 is formed at each of projections thereof with a plurality of holes 32*a* in a row in a longitudinal direction of the projection.

The cathode substrate 13, as shown in FIG. 6, is formed thereon with the cathode electrode line 34, on which the resistive layer 33 is arranged. Then, the insulating layer 12 is arranged on the resistive layer 33, followed by arrangement of the above-described focusing electrode 31 and gate electrode 32 on the insulating layer 12. The holes 32*a* are formed through the gate electrode 32 and insulating layer in a manner to commonly extend therethrough and the conical emitter 11 is arranged in each of the holes 32*a* while being placed on the resistive layer 33. The gate electrode 32 and focusing electrode 31 have a gate electrode voltage and a focusing electrode voltage applied thereto, respectively.

As described above, the plane focusing type FEC essentially fails to fully surround the gate electrode 32 with the focusing electrode 31. This causes electron beams emitted from the conical emitters 11 to leak through an opening of the focusing electrode 31 as indicated at an arrow in FIG. 5, resulting in failing to provide a desired spot diameter of electron beams.

Such a problem is due to the fact that the conventional plane focusing type FEC fails to arrange any electrode or structure between the gate electrode and a line for feeding a voltage to the gate electrode in a manner to surround the gate electrode. Thus, the problem is not restricted to only the focusing electrode. Also, the conventional plane focusing type FEC, even when the focusing electrode or structure is arranged so as not to fully surround the gate electrode, causes relationship in arrangement between the line for feeding a voltage to the gate electrode and the focusing electrode or structure to be subject to restriction.

SUMMARY OF THE INVENTION

The present invention has been made in view of the foregoing disadvantage of the prior art.

Accordingly, it is an object of the present invention to provide a field emission device which is capable of permitting any desired electrode or structure to be arranged around a gate electrode without any restriction.

It is another object of the present invention to provide a field emission device which is capable of permitting a focusing electrode to be arranged around a gate electrode, to thereby simplify a process of manufacturing thereof and substantially reducing a spot diameter of electron beams.

In accordance with the present invention, a field emission device is provided. The field emission device generally includes an insulating layer having an upper surface and a lower surface, a gate electrode arranged on the upper surface of the insulating layer, holes formed through the insulating layer and gate electrode in a manner to commonly extend through both, emitters arranged in the holes, respectively, a gate electrode line, and a cathode electrode line. The gate electrode line is arranged on the upper surface of the insulating layer. A connection line is arranged on the lower surface of the insulating layer. A first interlayer connection is arranged so as to electrically connect the gate electrode to the connection line therethrough and a second interlayer connection is arranged so as to electrically connect the gate electrode line to the connection line therethrough.

Also, in accordance with the present invention, a field emission device is provided. The field emission device generally includes an insulating layer having an upper surface and a lower surface, a gate electrode arranged on the upper surface of the insulating layer, holes formed through the insulating layer and gate electrode in a manner to commonly extend through both, emitters arranged in the holes, respectively, a gate electrode line, and a cathode electrode line. The cathode electrode line is arranged on the upper surface of the insulating layer and the gate electrode line is arranged on the lower surface of the insulating layer. A first interlayer connection is arranged so as to electrically connect the gate electrode to the gate electrode line therethrough and a second interlayer connection is arranged so as to electrically connect the emitters to the cathode electrode line therethrough.

In a preferred embodiment of the present invention, a focusing electrode is arranged on the upper surface of the insulating layer so as to surround the gate electrode.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Figure 1:
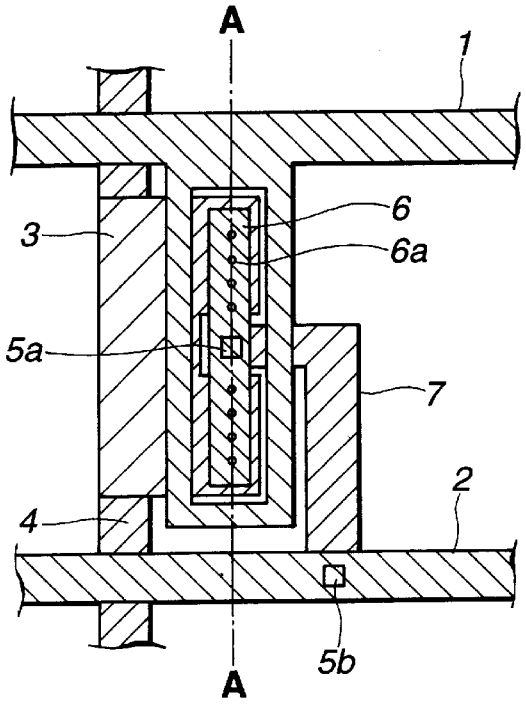
FIG. 1 is a fragmentary plan view showing an FEC incorporated in an embodiment of a field emission device according to the present invention.

Referring now to the drawings, wherein like reference numerals designate identical or corresponding parts throughout the several views, and more particularly to FIGS. 1–4 thereof, there are illustrated therein exemplary embodiments of a field emission device according to the present invention.

Figure 2:
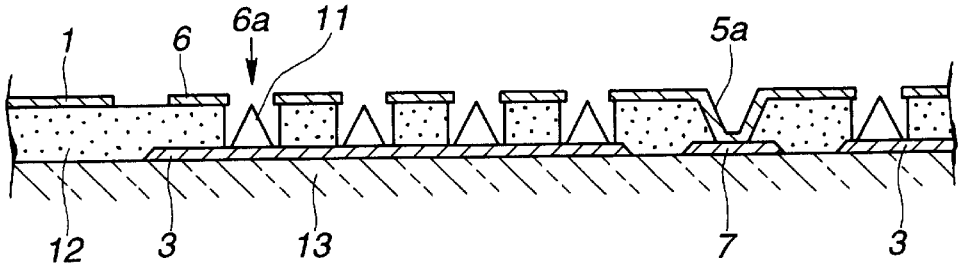
FIG. 2 is a fragmentary vertical sectional view of the FEC shown in FIG. 1.
Figure 3A:
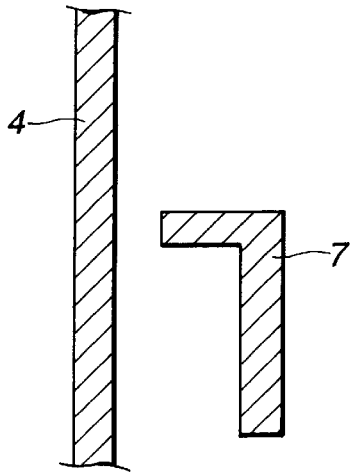
FIGS. 3(*a*) to 3(*d*) each are a schematic view showing each of steps in manufacturing of the FEC shown in FIG. 1.
Figure 3B:
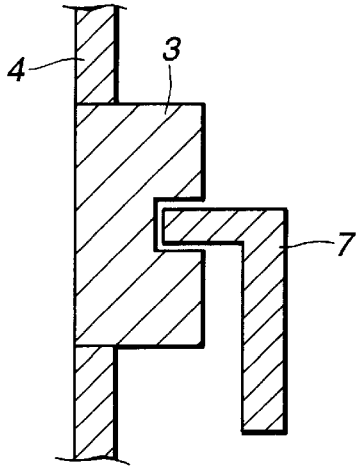
Figure 3C:
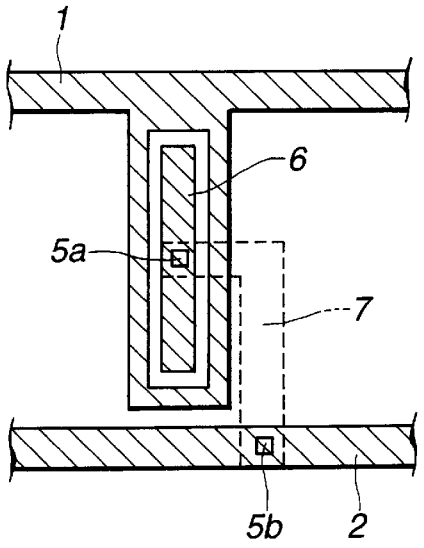
Figure 3D:
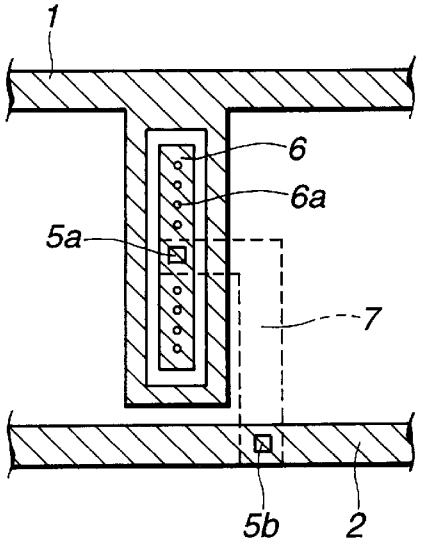

Referring first to FIGS. 1 and 2, an FEC incorporated in an embodiment of a field emission device according to the present invention is illustrated. In FIGS. 1 and 2, reference numeral 1 designates a focusing electrode, 2 is a gate electrode line, 3 is a resistive layer, 4 is a cathode electrode line, 5*a* and 5*b* each are a contact hole, and 6 is a gate electrode. 6*a* designates each of holes and 7 is a connection line. FIG. 1 is a plan view showing a cathode substrate-side laminate structure viewed from an anode side. FIG. 1 is drawn so as to permit an inside of the FEC to be observed through an insulating layer 12 and shows the gate electrode 6 for one unit.

The field emission device of the illustrated embodiment, as shown in FIG. 2, includes a cathode substrate-side structure, which includes a cathode substrate 13. The cathode substrate 13 is provided thereon with the insulating layer 12, which has the gate electrode 6 arranged on an upper surface thereof. The insulating layer 12 and gate electrode 6 are formed with the holes 6*a* in a manner to commonly extend through both. The holes 6*a* each are provided therein with an emitter 11 of a conical shape. The insulating layer 12 is formed on the upper surface thereof acting as a gate layer with the focusing electrode 1 in addition to the gate electrode 6 described above. The focusing electrode 1 is arranged around the gate electrode 6. Also, the insulating layer 12 is provided on the upper surface thereof with the gate electrode line 2 as shown in FIG. 1. The insulating layer 12 is provided on a lower surface thereof acting as a cathode layer with the connection line 7 and resistive layer 3, as well as the cathode electrode line 4 shown in FIG. 1. The gate electrode 6 is electrically connected through the contact hole 5*a* acting as a first interlayer connection to the connection line 7 as shown in FIG. 2 and the gate electrode line 2 is electrically connected through the contact hole 5*b* acting as a second interlayer connection to the connection line 7 as shown in FIG. 1. The cathode substrate-side structure thus constructed into a laminate structure is sealedly jointed to an anode substrate-side structure (not shown) while being spaced therefrom, resulting in providing an envelope, which is then evacuated.

The cathode electrode line 4, as shown in FIG. 1, is formed on a part of a region thereof with the resistive layer 3, on which the insulating layer 12 is arranged. The cathode electrode line 4 is connected to a display control unit (not shown) arranged outside the field emission device of the illustrated embodiment. The gate electrode 6 is arranged on a part of the upper surface of the insulating layer 12 positioned above the resistive layer 3 and the conical emitter 11 is arranged in each of the holes 6*a* while being placed on the resistive layer 3. The cathode electrode line 4 is provided so as not to be present under a portion of the resistive layer 3 on which the conical emitter 11 is arranged.

The gate electrode 6 and focusing electrode 1 are arranged on the insulating layer 12 in a manner to be positioned on the same plane of the upper surface thereof. The focusing electrode 1 includes a frame-like section which is hollowed out into a rectangular shape. The focusing electrode 1 surrounds the gate electrode 6 with the frame-like section thus formed. The focusing electrode 1 also includes an electrode line arranged so as to extend in a lateral direction thereof, which is united with focusing electrodes of other row lines and then connected to the external display control unit through a terminal. The gate electrode line 2 is likewise provided on the upper surface of the insulating layer 12 and arranged so as to extend in the lateral direction. The gate electrode line 2 is connected to the display control unit for every row line.

The connection line 7 arranged on the lower surface of the insulating layer 12 is formed into an inverted L-shape and connected at one end thereof through the contact hole 5*a* to a central portion of the gate electrode 6 defined in a longitudinal direction thereof. The resistive layer 3 is recessed at a portion thereof in proximity to a connection between the connection line 7 and the gate electrode 6, resulting in being formed into a recessed shape as a whole. This prevents the resistive layer 3 from being contacted with the connection 7. Thus, the connection line 7 is guided below the focusing electrode 1 and then connected at the other end thereof through the contact hole 5*b* to the gate electrode line 2. The plural conical emitters 11 arranged in the holes 6*a* are electrically connected through the resistive layer 3 to the cathode electrode line 2.

The resistive layer 3 is formed over a region extending from a position below the gate electrode 6 of a longitudinally extending rectangular shape to a position above the cathode electrode line 4 linearly extending in a longitudinal direction. The resistive layer 3 functions to limit an excess current flowing through the cathode electrode line 4. The resistive layer 3 prevents flowing of an excessive current through the gate electrode line 2 and cathode electrode line 4, when discharge or short-circuit occurs between the gate electrode 6 and a tip of one of the conical emitters 11 in the case that the resistive layer 3 is not provided. Of a number of conical emitters 11, any conical emitter is possibly liable to emit light. This often results in an abnormally bright spot occurring on an image plane. The resistive layer 3, when any one of the conical emitters 11 begins to emit an excessively large current, reduces a voltage applied to the conical emitter 11 concerned, to thereby ensure stable electron emission.

The interlayer connections or wirings constituted by the contact holes 5*a* and 5*b* permit the gate electrode 6 and gate electrode line 2 arranged on the upper surface of the insulating layer 12 to be connected to each other on the lower surface thereof. The gate electrode 6 and gate electrode line 2 are separated from each other on the upper surface of the insulating layer 12, so that the gate electrode 6 may be fully surrounded with the focusing electrode 1. This eliminates leakage of electron beams, resulting in a desired spot diameter of electron beams being obtained with ease.

Now, manufacturing of the FEC constructed as described above will be described hereinafter with reference to FIGS. 3(*a*) to 3(*d*).

First, as shown in FIG. 3(*a*), a cathode material such as niobium (Nb) or the like is deposited in the form of a film on the cathode substrate 13 (FIG. 2) made of glass or the like by sputtering or the like, resulting in a pattern of the cathode electrode line 4 and connection line 7 being provided.

Then, as shown in FIG. 3(*b*), a pattern of the resistive layer 3 is formed so as to cover a part of the cathode electrode line 4. The resistive layer 3 is formed with a recess for avoiding or keeping clear of the connection line 7. The resistive layer 3 may be formed of a Si material such as amorphous silicon doped with impurities into a film by chemical vapor deposition (CVD).

These cathode electrode line 4, connection line 7 and resistive layer 3 cooperate with each other to constitute a lower layer structure, on which the insulating layer 12 (FIG. 2) is formed of $SiO_2$ into a film by CVD. The insulating layer 12 is then subject to pattern etching using a photoresist and a hydrofluoric acid solution, resulting in holes for the contact holes 5*a* and 5*b* being formed. The holes are formed in such a manner that a side surface thereof is inclined so as permit an opening or open end thereof to be enlarged.

Subsequently, as shown in FIG. 3(*c*), Nb or the like is deposited in the form of a film on the insulating layer 12 by sputtering deposition or the like, so that a pattern of the gate electrode 6, focusing electrode 1 and gate electrode line 2 may be formed on the insulating layer 12. At this time, the sputtering deposition is carried out on the inclined side surface of each of the holes for the contact holes 5*a* and 5*b* and a bottom surface thereof, resulting in the contact holes 5*a* and 5*b* being formed. The thus-formed gate electrode 6, focusing electrode 1 and gate electrode line 2 cooperate together to constitute an upper layer structure, resulting in the cathode substrate-side laminate structure being provided. The resistive layer 3 may be left over a whole length of the connection line 7 and cathode electrode line 4. At this time, the resistive layer 3 is bored at portions thereof positionally corresponding to the contact holes 5*a* and 5*b*, to thereby ensure sputtering deposition thereon.

The subsequent procedure may be executed in substantially the same manner as the prior art. More specifically, a photoresist layer is coated on the upper layer structure to form a hole pattern for the holes 6*a* and anisotropic etching is carried out by reactive ion etching (RIE), so that the holes 6*a* may be formed. Then, a peel layer is selectively formed on only a surface of the gate electrode by oblique deposition. Then, a buffer layer is deposited in the form of a film on a portion of the resistive layer 3 positioned in each of the holes 6*a*. Thereafter, a high-melting metal material such as molybdenum (Mo) or the like is deposited on the portion of the resistive layer 3 by electron beam deposition, ion plating or the like, to thereby form the conical emitter 11 (FIG. 2). A nitride of the metal material or an oxide thereof may be substituted for the metal material. Then, the peel layer and the emitter material laminated thereon are concurrently removed from the surface of the gate electrode 6.

The above-described construction of the illustrated embodiment is for one block of the gate electrode 6. When color display of three colors is desired, three blocks for the respective colors are arranged adjacently to each other to provide one luminous unit. In this instance, the focusing electrodes 1 respectively surrounding the gate electrodes adjacent to each other are connected to each other through the electrode line thereof extending in the lateral direction. Alternatively, the frame portions of the focusing electrode adjacent to each other are integrated with each other, to thereby provide an electrode line which entirely extends in the lateral direction, wherein holes of a rectangular shape in which the gate electrodes are arranged are formed side by side.

In the field emission device of the illustrated embodiment thus constructed, the holes 6*a* may have a diameter of about 1 $\mu$m and formed at intervals of several microns in a successive manner. In order to permit electrons to be emitted in an amount sufficient for a display device, one block of the gate electrode may be formed with tens of holes 6*a* and conical emitters. A gap between the cathode substrate-side structure and the anode substrate-side structure is set to be 1 to 2 mm and a voltage of several kV is applied to the anode. In a display device of a high-voltage type, the number of conical emitters 11 required may be reduced because it does not require a large amount of cathode current. In the illustrated embodiment, the holes 6*a* are arranged in a row. Alternatively, they may be arranged in two or more rows.

The gate electrode line 2 is scanned for determining a line in a horizontal direction in which luminescence is carried out. For this purpose, a voltage of about 0 to 100 V is applied thereto. The cathode electrode line 4 is driven while being subject to pulse width modulation for the purpose of graduated or contrasted display. Thus, it has a voltage of about 0 to 60 V applied thereto. A voltage applied to the focusing electrode 1 is set to be within a range of about 0 to −70 V depending on a degree of focusing. A gap between the gate electrode 6 and the focusing electrode 1 is determined depending on a degree of focusing. In the illustrated embodiment, it may be set to be about 10 $\mu$m. A voltage applied to the focusing electrode 1 may be kept constant. A portion of the focusing electrode which does not contribute to luminescence is subject to switching so as to be open with respect to a power supply, resulting in reducing an electric power consumed due to loss of an electrostatic capacity formed between the focusing electrode 1 and the cathode electrode line 4.

Figure 4:
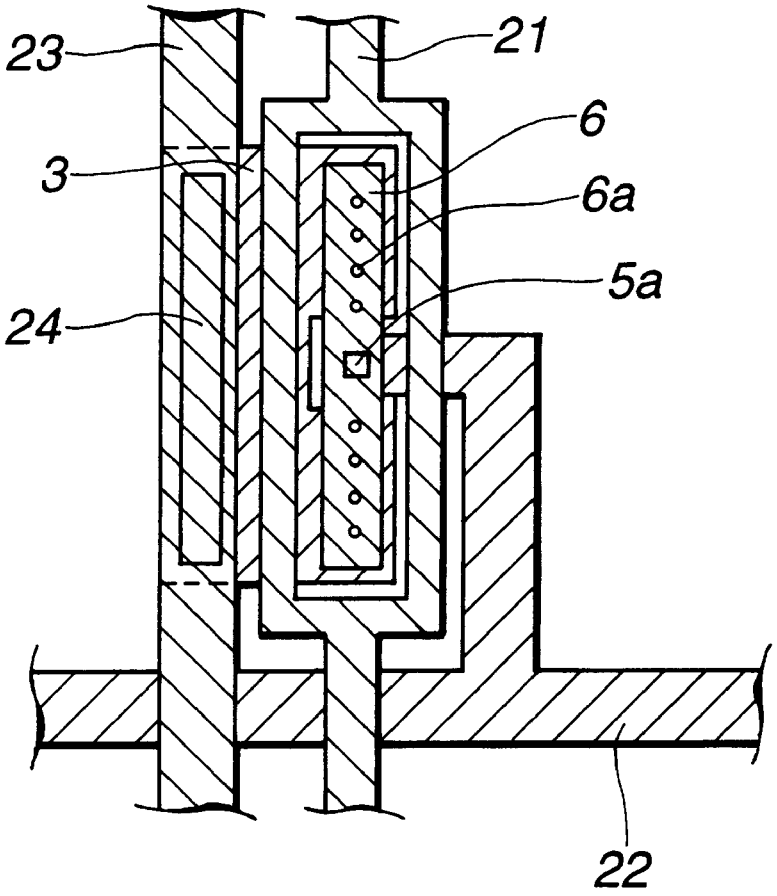
FIG. 4 is a fragmentary plan view showing an FEC incorporated in another embodiment of a field emission device according to the present invention.
Figure 5:
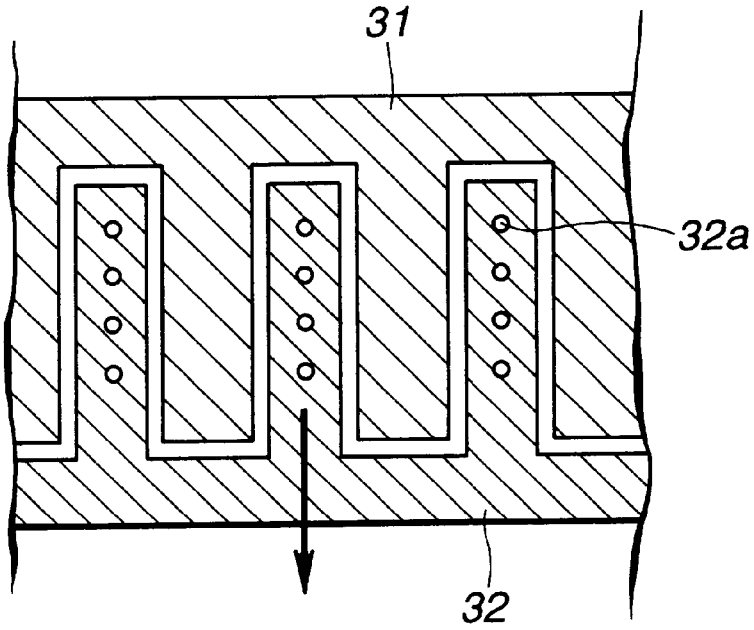
FIG.5 PRIOR ART
FIG. 5 is a fragmentary plan view showing a plane focusing-type FEC.
Figure 6:
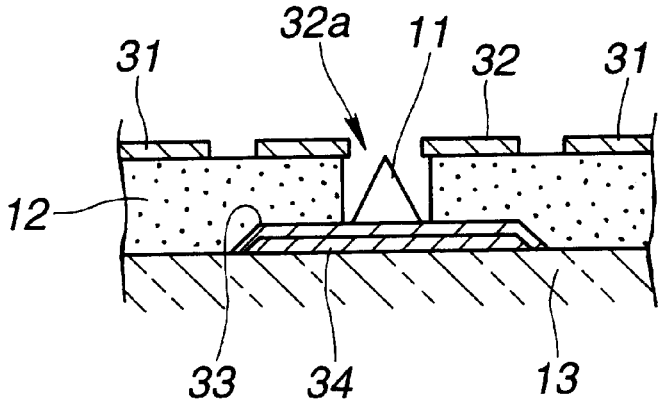
FIG.6 PRIOR ART
FIG. 6 is a fragmentary plan view showing a plane focusing-type FEC.

Referring now to FIG. 4, an FEC incorporated in a second embodiment of a field emission device according to the present invention is illustrated. FIG. 4 likewise is a plan view showing a cathode substrate-side laminate structure viewed from an anode side and is drawn so as to permit an inside of the FEC to be observed through an insulating layer. In FIG. 4, reference numerals 21, 22, 23 and 24 respectively designate a focusing electrode, a gate electrode line, a cathode electrode line and each of contact holes, which are constructed in a manner different from the above-described embodiment.

In the first embodiment shown in FIGS. 1 to 3, the gate electrode line 2 is arranged on the upper surface of the insulating layer 12 (FIG. 2) and the cathode electrode line 4 is arranged on the lower surface of the insulating layer 12. On the contrary, in the illustrated embodiment, the cathode electrode line 23 is arranged on an upper surface of an insulating layer (not shown) and the gate electrode line 22 is arranged on a lower surface thereof. Therefore, arrangement of the cathode electrode line 23 and gate electrode line 22 in the illustrated embodiment is contrary to that in the above-described embodiment. Thus, the gate electrode line 22 has a configuration in plan corresponding to a combined configuration of the connection line 7 and gate electrode line 2 shown in FIG. 1. The gate electrode line 22 is connected to a gate electrode 6 through a contact hole 5*a* acting as a first interlayer connection. Also, conical emitters 11 are electrically connected to the cathode electrode line 23 arranged on the upper surface of the insulating layer through a resistive layer 3 and the contact hole 24 formed over a relatively increased region and acting as a second interlayer connection.

Thus, the focusing electrode 21 fully surrounding the gate electrode 6 and the longitudinally extending cathode electrode line 23 are arranged on the upper layer of the insulating layer, whereas the gate electrode line 22 is arranged on the lower surface thereof. Such arrangement permits the gate electrode line 22 to be connected to the gate electrode 6 while avoiding the focusing electrode 21 and be arranged so as to extend in a lateral direction while crossing the cathode electrode line 23. This results in the illustrated embodiment likewise preventing leakage of electron beams.

Manufacturing of the field emission device of the illustrated embodiment thus constructed may be carried out in substantially the same procedure as in the above-described embodiment except that the order of formation of the gate electrode line 2 and cathode electrode line 4 is reversed and the contact hole 24 is substituted for the contact hole 5*b*. The resistive layer 3 may be left over a whole length of the gate electrode line 22.

The above-described construction of the illustrated embodiment shown in FIG. 4 is for one block of the gate electrode 6 as in FIG. 1. When color display of three colors is desired, three blocks for the respective colors are arranged adjacently to each other to provide one luminous unit. The focusing electrodes 1 respectively surrounding the gate electrodes 6 adjacent to each other are connected to each other through the electrode line thereof extending in a longitudinal direction. Alternatively, frame portions of the focusing electrode adjacent to each other are integrated with each other, to thereby provide an electrode line which entirely extends in the longitudinal direction, wherein holes of a rectangular shape in which the gate electrodes are arranged are formed side by side.

The remaining part of the illustrated embodiment may be constructed in substantially the same manner as the embodiment described above with reference to FIGS. 1 and 2.

In the embodiment shown in FIGS. 1 and 2, the conical emitters 11 are electrically connected through the resistive layer 3 to the cathode electrode line 4. Alternatively, the conical emitters 11 may be electrically connected directly to the cathode electrode line 4 without interposing the resistive layer 3 therebetween. Instead, the connection may be accomplished by means of any metal layer as well as the resistive layer 3 interposed therebetween. In the embodiment of FIG. 4 as well, electrical connection between the conical emitters 11 and the cathode electrode line 24 may be carried out through only the contact holes without using the resistive layer 3. Alternatively, the electrical connection may be attained by interposing any metal layer as well as the resistive layer therebetween.

In each of the above-described embodiments, the gate electrode is formed into an elongated rectangular shape. Alternatively, it may be formed into any other suitable shape such as a circular shape. The focusing electrode is not necessarily required to fully surround the gate electrode. It may be arranged so as to partially surround the gate electrode so long as it effectively prevents leakage of electron beams.

The above description has been made in connection with the field emission device of the high-voltage type. It is a matter of course that the present invention may be effectively applied to a field emission device of the low-voltage type. In this instance, the focusing electrode is arranged to improve focusing of electron beams or control a focusing voltage to control the focusing.

Also, the above description has been made in connection with the field emission device including the focusing electrode, however, the present invention may be effectively applied to the construction that any other electrode or structure is arranged around the gate electrode.

As can be seen from the foregoing, the present invention permits any desired electrode or structure to be arranged around the gate electrode without any restriction.

Arrangement of the focusing electrode around the gate electrode prevents leakage of electron beams to provide a desired spot diameter of electron beams. Also, the field emission device of the present invention reduces the number of layers as compared with the conventional field emission device of the two-stage gate type, to thereby permit manufacturing thereof to be facilitated.

While preferred embodiments of the present invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A field emission device, comprising:

an insulating layer having an upper surface and a lower surface;

a gate electrode arranged on said upper surface of said insulating layer;

holes formed through said insulating layer and said gate electrode in a manner to extend commonly to both;

emitters arranged in said holes, respectively;

a gate electrode line;

a cathode electrode line;

said cathode electrode line being arranged on said upper surface of said insulating layer;

said gate electrode line being arranged on said lower surface of said insulating layer;

a first interlayer connection for electrically connecting said gate electrode to said gate electrode line therethrough; and a second interlayer connection for electrically connecting said emitters to said cathode electrode line therethrough.

2. The field emission device as defined in claim 1, further comprising a focusing electrode arranged on said upper surface of said insulating layer so as to surround said gate electrode.

* * * * *